US006908369B2

(12) United States Patent
Tada

(10) Patent No.: US 6,908,369 B2
(45) Date of Patent: Jun. 21, 2005

(54) APPARATUS FOR AND METHOD OF SMOOTHING SUBSTRATE SURFACE

(75) Inventor: Tetsujiro Tada, Tokyo (JP)

(73) Assignee: NIHON Microcoating Co., Ltd., Tokyo (JP)

( * ) Notice: Subject to any disclaimer, the term of this patent is extended or adjusted under 35 U.S.C. 154(b) by 55 days.

(21) Appl. No.: 10/616,574

(22) Filed: Jul. 9, 2003

(65) Prior Publication Data

US 2004/0072504 A1 Apr. 15, 2004

(30) Foreign Application Priority Data

Sep. 24, 2002 (JP) ..... 2002-276505

(51) Int. Cl.[7] ..... B24B 7/30

(52) U.S. Cl. ..... 451/59; 451/63; 451/302; 451/303; 451/307

(58) Field of Search ..... 451/59, 302, 303, 451/304, 307, 41, 63

(56) References Cited

U.S. PATENT DOCUMENTS 617,940 A * 1/1899 Rowland ..... 451/302
2,753,670 A * 7/1956 Carapucci ..... 451/419
4,091,573 A * 5/1978 Schmidt ..... 451/302
5,018,311 A * 5/1991 Malagrino et al. ..... 451/302
5,099,615 A * 3/1992 Ruble et al. ..... 451/5
5,507,684 A * 4/1996 Schwar ..... 451/5
6,095,909 A * 8/2000 Chenu ..... 451/302
6,155,914 A * 12/2000 Reynen et al. ..... 451/168

FOREIGN PATENT DOCUMENTS

| | | |
|---|---|---|
| JP | 5-12075 | 2/1993 |
| JP | 2002-0312897 | 1/2002 |
| JP | 2002-113648 | 4/2002 |

* cited by examiner

*Primary Examiner*—Eileen P. Morgan
(74) *Attorney, Agent, or Firm*—Beyer Weaver & Thomas LLP

(57) ABSTRACT

An apparatus for smoothing a surface of a rotatably supported substrate includes a base plate, a block having an extending arm structure and being attached to the base plate so as to be movable along the surface of the base plate, a roller attached to a tip portion of the arm structure in a direction perpendicular to the base plate, a mobile member attached to the arm structure so as to be movable perpendicularly to the axial direction of the roller, a tape-running device attached to the base plate for feeding and taking up a polishing tape through the roller so as to advance the tape around the mobile member, and a moving device attached to the arm structure of the block for moving the mobile member.

12 Claims, 5 Drawing Sheets

APPARATUS FOR AND METHOD OF SMOOTHING SUBSTRATE SURFACE

BACKGROUND OF THE INVENTION

This invention relates to an apparatus for and a method of smoothing the surface of a substrate such as a magnetic disk substrate.

A magnetic disk substrate serving as a magnetic memory medium is generally produced by forming a NiP layer on the surface of an aluminum or glass substrate, carrying out a texturing process to form a concentrically circular texturing marks on the surface of this NiP layer, thereafter forming a magnetic layer thereon by a sputtering process or the like and then further forming a lubricating protective membrane. According to such a prior art method of production, abnormal protrusions appear on the disk surface in the final stage and such abnormal protrusions are likely to hit the magnetic head, thereby damaging the magnetic disk surface or to cause foreign objects to become attached to the magnetic head. Debris particles thus generated during the production process are also likely to become attached to the disk surface.

In order to remove such abnormal protrusions and debris particles, it has been customary to carry out a surface smoothing process. Japanese Patent Publication Tokko 2-10486, for example, disclosed a smoothing process for the surface of a disk substrate by using a polishing tape with a polishing layer formed thereon and causing it to run while using a rubber roller or the like to apply a pressure for removing the abnormal protrusions on the surface. A smoothing method by running a polishing tape while blowing air from behind the polishing tape, instead of using a roller, has also been practiced. Japanese Patent Publication Tokkai 2001-162504 disclosed another smoothing process by pressing a polishing tape onto the surface of the disk substrate by means of a pad while the disk substrate is caused to rotate and the pad is moved reciprocatingly in a radial direction of the substrate.

The smoothing process carried out while a polishing tape is pressed by means of a rubber roller is effective from the point of view of removing the abnormal protrusions from the surface but is not capable of either preventing the generation of debris particles or removing them since the polishing tape and the rubber roller interfere each other during the polishing process. The method with air is capable of preventing the generation of debris particles because there is no interference such as between a rubber roller and the polishing tape but tends to bring in the debris particles from the surrounding areas because of the air movement. The method of using a pad to press the polishing tape is effective not only in removing debris particles but also in preventing their generation because the polishing tape is not caused to run at the time of polishing, unlike the method using a rubber roller, but there is an interference between the edges of the polishing tape and the pad even while the polishing tape is not running. Moreover, the polishing tape and the pad interfere with respect to each other when the polishing tape is run without contacting the disk substrate for the preparation of a next polishing process. Thus, there is a limit to how much the generation of debris particles due to the falling of abrading particles can be prevented.

SUMMARY OF THE INVENTION

It is therefore an object of this invention in view of the above to provide an apparatus for and a method of preventing the generation of particles when using a polishing tape to smoothen the surface of a substrate.

It is another object of this invention to provide an apparatus for and a method of preventing the generation of particles due to the falling of abrading particles when using a polishing tape to smoothen the surface of a substrate.

An apparatus embodying this invention for smoothing a surface of a rotatably supported substrate may be characterized not only as comprising a base plate, a block ("the first block") having an extending arm structure and being attached to the base plate so as to be movable along a surface thereof, a roller ("the first roller") attached to a tip portion of the arm structure in a direction perpendicular to the surface of the base plate, a mobile member ("the first mobile member") attached to the arm structure so as to be movable perpendicularly to the axial direction of the roller, a tape-running means ("the first tape-running means") attached to the base plate for feeding and taking up a polishing tape through the roller so as to advance the tape around the mobile member, and a moving means ("the first moving means") attached to the arm structure of the block for moving the mobile member but also wherein the mobile member has a pad which presses the polishing tape from backside and wherein the mobile member moves by means of the moving means to a retracted position where the pad does not contact the polishing tape when the polishing tape is being run by means of the tape-running means and to a compressing position where the pad pushes the polishing tape when the substrate is being smoothed by the polishing tape.

For smoothing both surfaces of the substrate at the same time, such an apparatus may additionally comprise a second block, a second roller, a second tape-running means, a second mobile member and a second moving means which are structured like and disposed symmetrically to the aforementioned first block, first roller, first tape-running means, first mobile member and first moving means, respectively.

An apparatus according to another embodiment of this invention may be characterized not only as comprising a base plate having an extending first arm structure ("the first arm structure"), a roller ("the first roller") attached to a tip portion of the arm structure perpendicularly to the base plate, a block ("the first block") having a mobile member ("the first mobile member") which extends along the arm structure and being attached to the base plate so as to be movable along the base plate, a tape-running means ("the first tape-running means") attached to the base plate for feeding and taking up a polishing tape through the roller so as to advance the tape around the mobile member, and a moving means ("the first moving means") attached to the base plate for moving the mobile member but also wherein the mobile member has a pad which presses the polishing tape from backside and wherein the mobile member moves by means of the moving means to a retracted position where the pad does not contact the polishing tape when the polishing tape is being run by means of the tape-running means and to a compressing position where the pad pushes the polishing tape when the substrate is being smoothed by the polishing tape.

For smoothing both surfaces of the substrate at the same time, this apparatus may also additionally comprise a second arm structure extending from the base plate parallel to the first extending arm structure such that the substrate can be disposed between the two arm structures as well as a second block, a second roller, a second tape-running means, a second mobile member and a second moving means which are structured like and disposed symmetrically to the aforementioned first block, first roller, first tape-running means, first mobile member and first moving means, respectively.

It is preferable that the pads be narrower than the polishing tapes.

BRIEF DESCRIPTION OF THE DRAWINGS

Throughout herein, components that are like or equivalent to each other are indicated by the same numerals and may not be repetitiously described.

DETAILED DESCRIPTION OF THE INVENTION

Figure 1:
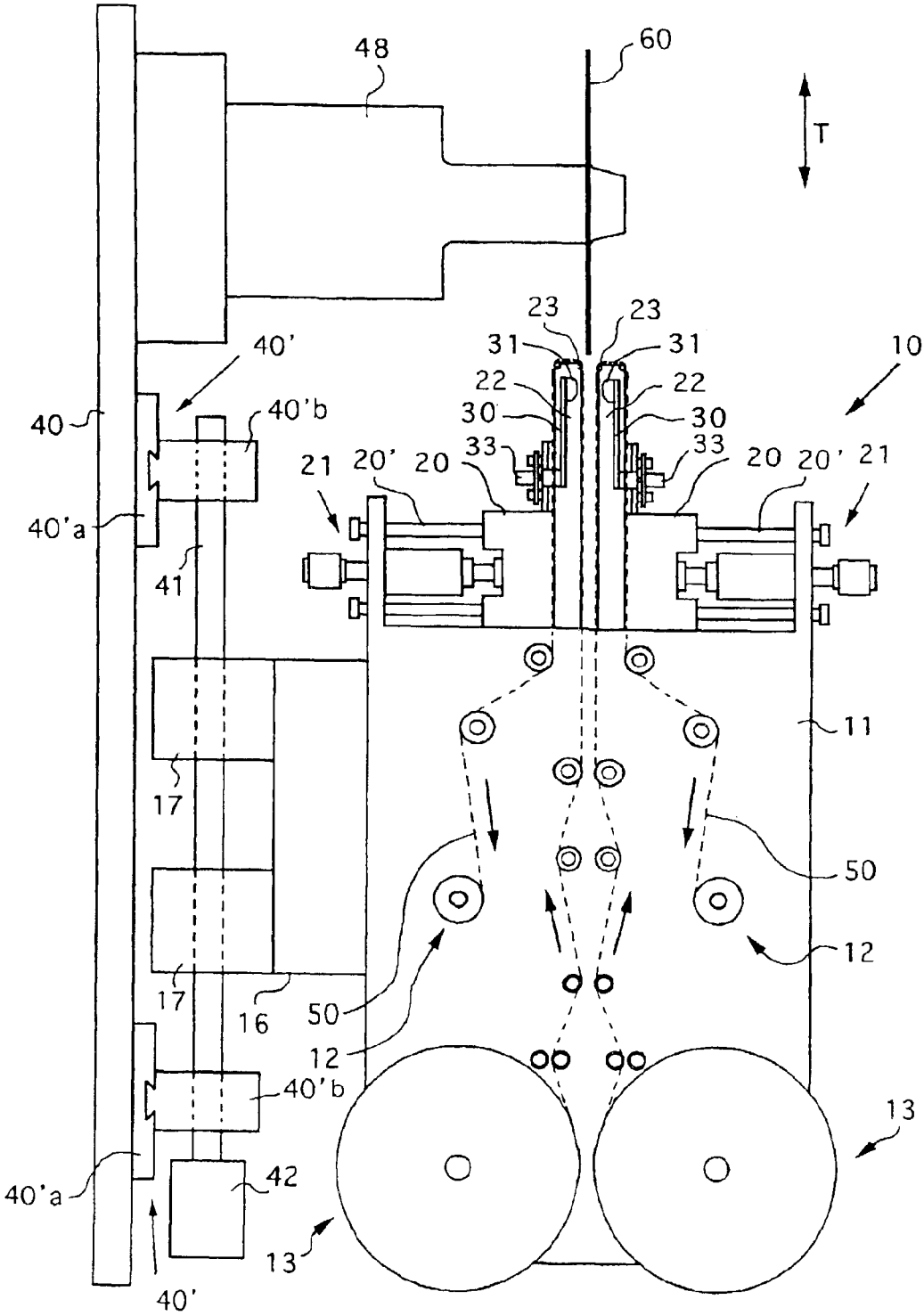
FIG. 1 is a plan view of a double side smoothing apparatus embodying this invention.

FIG. 1 shows a smoothing apparatus 10 embodying this invention adapted to simultaneously smoothen both surfaces of a substrate 60 (say, of a magnetic disk) but this may be used for the smoothing of only one surface at a time. The smoothing apparatus 10 is shown attached to a support table 40, together with a spindle 48 for supporting and rotating the substrate 60. The apparatus 10 has a base plate 11 which is affixed to a reciprocating table 16 having leg parts 17 provided with female screw holes elongated in the front-back direction indicated by double-headed arrow T. The base plate 11 of the apparatus 10 is attached to the support table 40 by way of a male screw 41 which is rotatably supported by block tables 40' attached to the support table 40, penetrates and engages these female screw holes. Each of these block tables 40' consists of a fixed part 40'*a* and a mobile part 40'*b* which is mobile in the vertical direction (perpendicular to the drawing). It is the mobile parts 40'*b* of the block tables 40' that the male screw 41 penetrates. As the male screw 41 is rotated by its motor 42, the apparatus 10 attached to the reciprocating table 16 can undergo a reciprocating motion in the direction of arrow T. Similarly, the apparatus 10 can be caused to undergo a reciprocating motion in the vertical direction (perpendicular to the drawing) as the mobile parts 40'*b* of the block table 40' are caused to move vertically by a similar mechanism (not shown). As the spindle 48 attached to the support table 40 is rotated while holding the substrate 60, its entire surface can be efficiently smoothed with the apparatus 10 thus moved reciprocatingly.

A pair of feed rollers 13 for feeding a polishing tape 50 and a pair of take-up rollers 12 for winding it up are disposed on the base plate 11 in a symmetrical manner to the left-hand and right-hand sides.

The base plate 11 is further provided with a pair of mutually oppositely disposed blocks 20 on its side of the spindle 48 so as to be able to slide along a surface of the base plate 11, being each connected to a block-moving means 21 affixed to the base plate 11. These block-moving means 21 may comprise, for example, a cylinder operated by air. As air is supplied to the cylinders, the pair of blocks 20 moves towards each other along guide rods 20'. As air is removed from these cylinders, the pair of blocks 20 moves away from each other.

Figure 2:
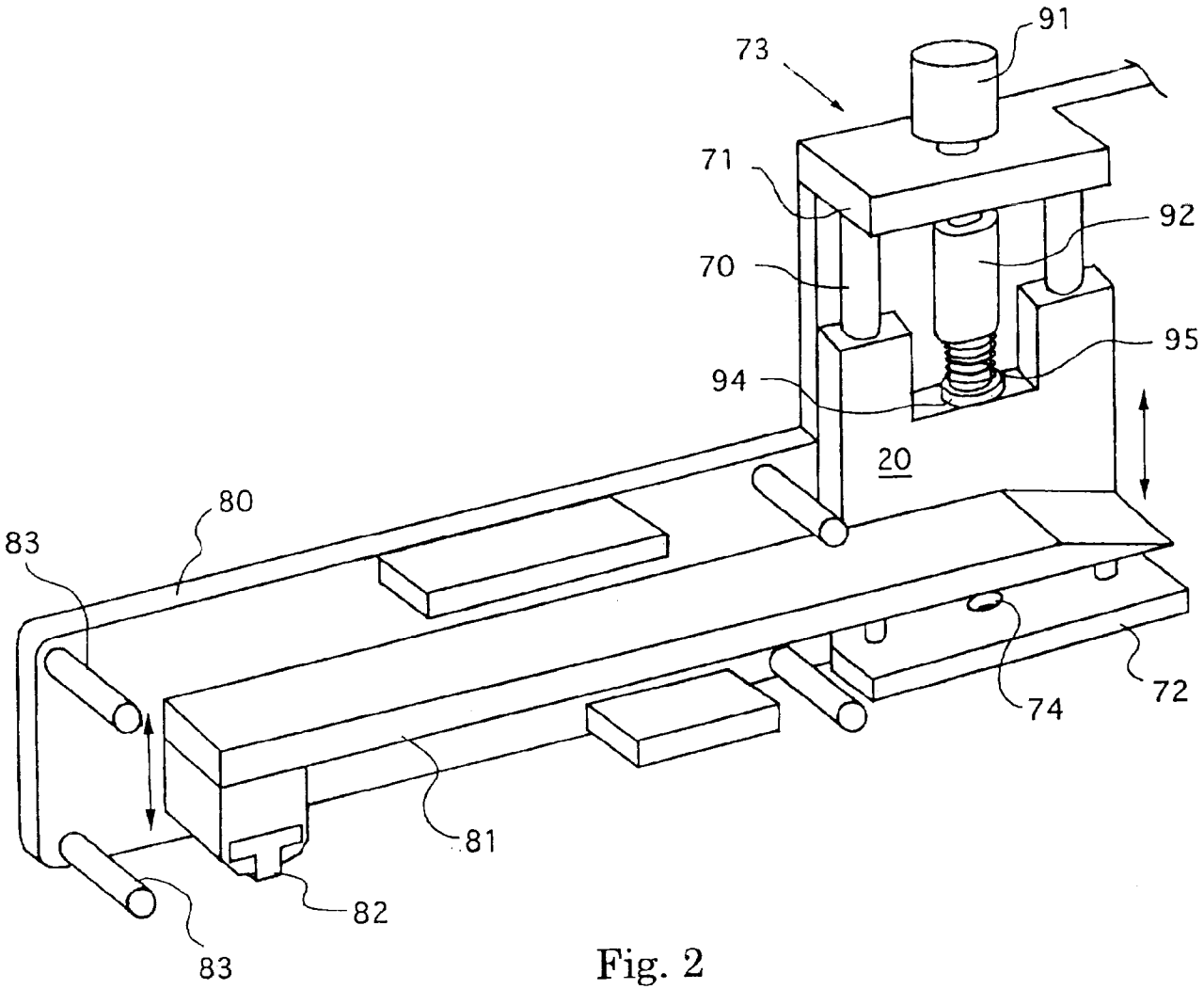
FIG. 2 is an enlarged diagonal view of one of the mobile members which are components of the apparatus of FIG. 1.

As shown more clearly in FIG. 2, each of the blocks 20 is provided with an arm 22 extending in the direction of the spindle 48. A plurality of direction-reversing rollers 23 are rotatably attached to the tip of the arm 22 perpendicularly to the horizontal main surface of the base plate 11, and each of the polishing tapes 50 is adapted to pass over these rollers 23. In other words, each polishing tape 50, unwound from corresponding one of the feed rollers 13, reaches these rollers 23 through a plurality of rollers on the base plate 11 as shown in FIG. 1, changes its direction of motion thereby and is taken up by corresponding one of the take-up rollers 12 through another plurality of rollers on the base plate 11 as shown in FIG. 1. FIG. 2 shows two such direction-reversing rollers 23 separated from each other by a distance S such that a sufficiently large gap is maintained between the portions of the tape 50 moving in one direction and in the opposite direction between the feed roller 13 and the take-up roller 12. A similar effect can be obtained by using a single roller with a large diameter. Alternatively, three or more such rollers may be provided.

Within this space of width about S formed between the two portions of the tape 50, there is disposed a mobile member 30 having a pad 31 affixed to its bottom surface (as seen in FIG. 2) for compressing the tape 50 and an extended part 32 which extends upward (as seen in FIG. 2) between the tape 50 and the arm 22. As shown in FIG. 1, the two mobile members 30 are disposed symmetrically to the two arms 22 such that their extended parts 32 extend away from each other. A cylinder 33 is affixed to each arm 22 and is connected to the extended part 32 of corresponding one of the mobile members 30 such that the mobile members 30 can be moved as air is introduced into and removed from these cylinders 33. The pads 31 are narrower than the width of the tapes 50 such that abrading particles can be prevented from falling off from the edges of the tapes 50 to generate debris particles as the pads 31 contact the tapes 50.

As the cylinders 33 retract their pistons, the mobile members 30 are each pulled towards the corresponding one of the cylinders 33 such that the pads 31 are separated from the tapes 50, as shown in FIG. 1. The tapes 50 are forwarded from the feed rollers 13 to the take-up rollers 12 without contacting the pads 31 while the mobile members 30 are at their retracted positions. This means that the production of debris particles due to the interference (or contact) between the tapes 50 and the pads 31 can be prevented as the tapes 50 are advanced.

As the cylinders 33 extend their pistons, the mobile members 30 are pushed such that each pad 31 not only contacts the corresponding tape 50 but also pushes it further outward as shown in FIG. 2. Thus, as explained below, the tape 50 can contact and polish the substrate 60.

The polishing tapes 50 may preferably be one produced by applying a resin binder (for example, of polyester or polyurethane type) on the surface of a plastic film (for example, of polyester or polyethylene terephthalate (PET)) of thickness 5 $\mu$m–100 $\mu$m and dispersing and fixing abrading particles (for example, of aluminum oxide, diamond or silicon carbide) with average diameter of 0.1 $\mu$m–10 $\mu$m, or by forming a polishing layer on the surface of a plastic film by covering it with a coating material with a resin binder having abrading particles dispersed therein, forming an antistatic membrane of thickness 0.1 μm–0.3 μm by applying an antistatic agent on the back surface of this plastic film, if necessary, and slitting it into the form of a tape. The tape is preferably of a width of about 12.6 mm (½ inch). In such a case, the width of the pads 31 is preferably about 10 mm, that is, smaller than the width of the tape.

Next, a method of using the smoothing apparatus 10 described above is explained for smoothing both surfaces of the magnetic disk substrate 60 but it is to be understood that the methods embodying this invention include situations where only one of the surfaces of the substrate 60 is smoothed.

The magnetic disk substrate 60 to be processed is set on the spindle 48 which serves not only to support the substrate 60 but also to rotate it. As the male screw motor 42 is activated, the base plate 11 of the apparatus 10 approaches the substrate 60 supported by the spindle 48. At this time, air is out of the cylinders of both block-moving means 21 such that the two blocks 20 are separated from each other by leaving a sufficiently wide gap in between for having the substrate 60 positioned in this gap. Air is also out of the cylinders 33 affixed to the arms 22 such that the mobile members 30 are at their retracted positions. Under this condition, the polishing tapes 50 are run from the feed rollers 13 to the take-up rollers 12 through the direction-reversing rollers 23 such that unused portions of the tapes 50 will contact the substrate 60.

Since the mobile members 30 are both retracted as the tapes 50 are caused to run, the tapes 50 contact only the rotatably supported rollers and do not rub against the pads 31. Thus, debris particles are not generated from the abrading particles that may fall off.

When the base plate 11 has moved to a specified position, each of the block-moving means 21 stops at a position close to the substrate 60 as air is supplied to the corresponding cylinder. Air is supplied then to the cylinders 33 affixed to the arms 22 such that the mobile members 30 move from their retracted positions to the compressing positions and the pads 31 press the tapes 50 from their back sides onto the surfaces of the substrate 60.

The substrate 60 is rotated by the spindle 48 while the block tables 40' move reciprocatingly in the vertical direction such that both surfaces of the substrate 60 are smoothed by the tapes 50. If the base plate 11 is additionally caused to undergo its reciprocating motion in the horizontal direction (in the direction of arrow T shown in FIG. 1) by means of the male screw motor 42, the polishing can be accomplished even more effectively. Since the pads 31 are somewhat narrower than the tapes 50, the pads 31 do not interfere with the edge parts of the tapes 50. This serves to prevent the abrading particles from falling off the tapes 50. Although the tapes 50 are generally stopped during the smoothing process described above, the tapes 50 may be caused to run in order to improve the smoothing efficiency even more.

After the smoothing process is completed, air is removed from each cylinder such that the mobile members 30 are moved back to their retracted positions and the pair of blocks 20 moves away from each other. The substrate 60 may then be removed from the spindle 48.

Figure 3:
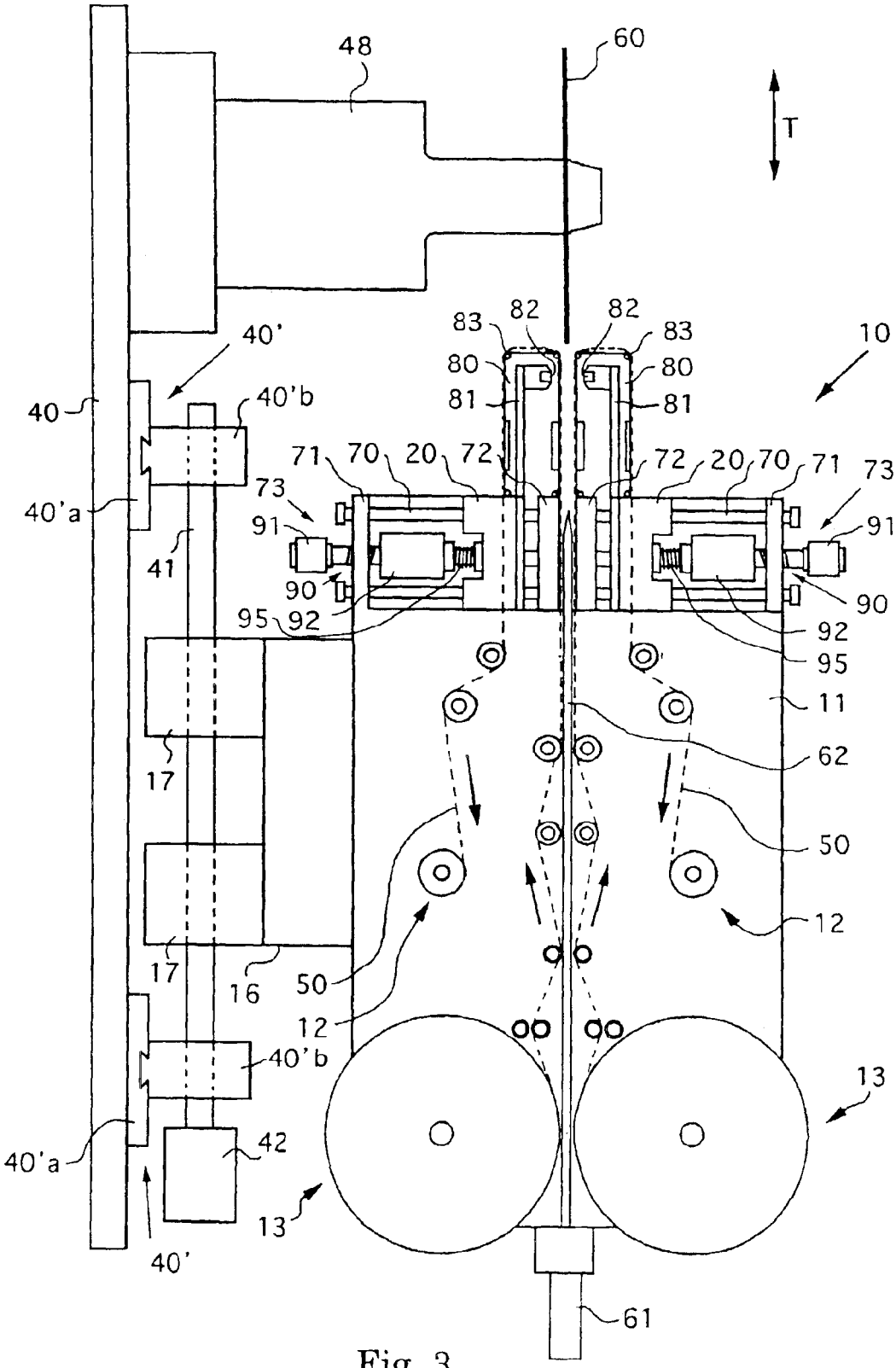
FIG. 3 is a plan view of another apparatus embodying this invention.

FIG. 3 shows another apparatus embodying this invention. Components that are similar to those shown in FIG. 1 are indicated by the same numerals and may not be repetitiously described. The apparatus shown in FIG. 3 is distinguishable from the one in FIG. 1 in that a block-moving rod 62 for moving the blocks 20 is provided between the pairs of feed rollers 13 and take-up rollers 12 which are symmetrically disposed so as to be able to move in the direction of arrow T by means of a motor 61 at one end of the rod 62. The blocks 20 are adapted to move away from each other if the block-moving rod 62 is moved towards them and to approach each other if the block-moving rod 62 is moved away from them.

Figure 4:
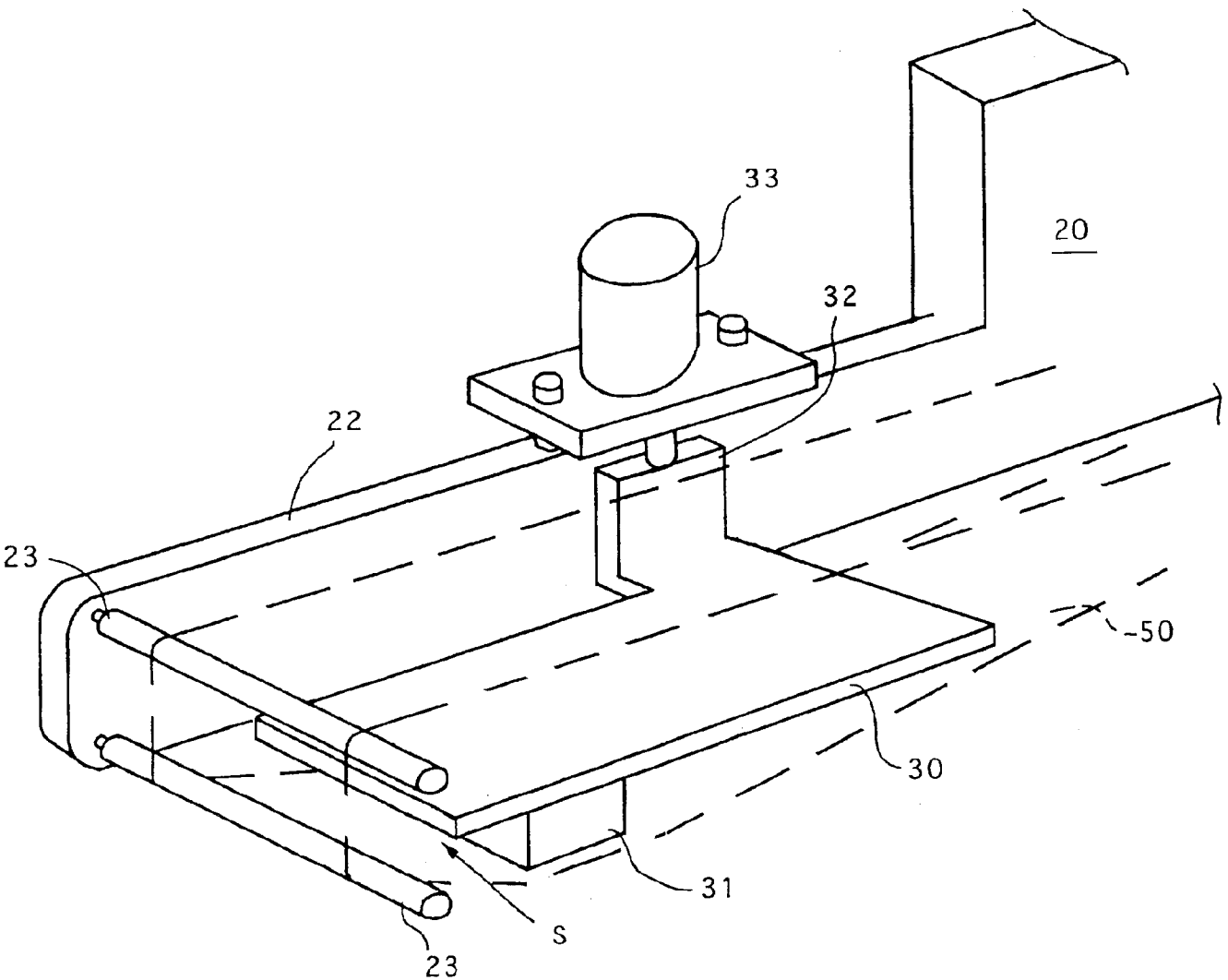
FIG. 4 is a diagonal view of one of the blocks of the apparatus shown in FIG. 3.

As shown in FIG. 4, each block 20 according to this embodiment of the invention is movable parallel to the surface of the base plate 11 along guide rods 70 which are provided between two protruding members 71 and 72 from an end part of the base plate 11 and by which the block is penetrated. Numeral 73 indicates a block-moving mechanism for moving the block 20 along these guide rods 70.

As shown in FIG. 5A, the block-moving mechanism 73 has a screw 90 which engages in a hole provided through the member 71. A knob 91 is provided at one end of this screw 90. As the screw 90 is rotated by handling the knob 91, the screw 90 is moved either towards or away from the block 20. A cylindrical tubular body 92 is attached to the other end of the screw 90, supporting a piston rod 93 inside this tubular body 92 so as to be movable in the axial direction inside the tubular body 92. A plate 94 is attached to the end of this piston rod 93 outside the tubular body 92 and a spring 95 is inserted between the plate 94 and the tubular body 92. The biasing force of this spring 95 operates on the piston rod 93 in the outward direction, normally keeping the plate 94 in contact with the block 20.

As the knob 91 is rotated such that the tubular body 92 approaches the block 20, the spring 95 begins to press the piston rod 93 against the block 20. Since the plate 94 on the piston rod 93 applies a force on the block 20 through a pressure sensor 96 buried inside the block 20, this compressive force can be detected by means of this pressure sensor 96.

The protruding member 72 has a hole 74 therethrough, as shown in FIG. 5A. The block 20 has a rounded protrusion 20*a* formed at an end position on the side facing the member 72 so as to penetrate the hole 74 completely and to protrude outward, as shown in FIG. 5B. The tip of the block-moving rod 62 is tapered and is adapted to contact the rounded end portion of the protrusion 20*a* as the rod 62 is advanced by means of the motor 61 at its end, thereby pushing the protrusion 20*a* back into the hole 74 and causing the block 20 to move toward the protruding member 71 against the biasing force of the spring 95. When the rod 62 is retracted, the biasing force of the spring 95 causes the block 20 to approach the protruding member 72 and its protrusion 20*a* is again pushed out of the hole 74.

As shown in FIG. 4, the base plate 11 has an arm structure 80 extending from an end portion behind the block 20. (This is different from the arm 22 affixed to the block 20 shown in FIGS. 1 and 2.) A plurality of rollers 83 are supported by this arm structure 80, as shown in FIG. 1, for allowing a tape 50 to run smoothly.

Figure 5:
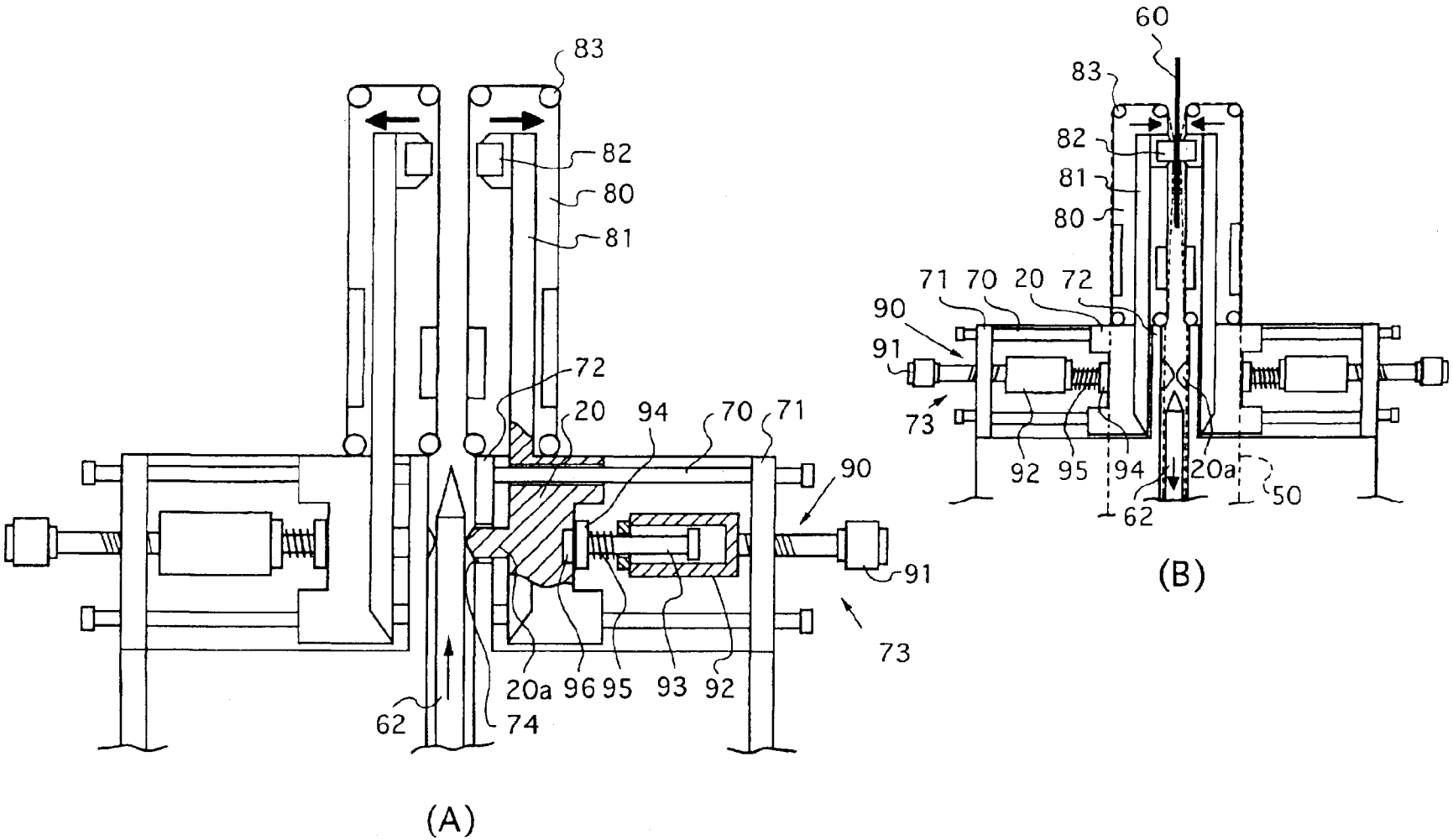
FIGS. 5A and 5B are sectional views for showing the operations of the block-moving mechanism of the apparatus shown in FIG. 3, FIG. 5A showing when the block-moving rod is pushed forward such that the blocks and the mobile members have moved away from each other, and FIG. 5B showing when the block-moving rod is retracted such that the blocks and the mobile members have moved close to each other and the pads have been pressed against the tapes.

A mobile member 81 extending parallel to the arm structure 80 is attached to the block 20, as shown in FIGS. 4 and 5. As the two blocks 20, symmetrically disposed as shown in FIG. 3, move towards or away from each other, the associated mobile members 81 also move towards or away from each other. A pad 82 is attached to each of these mobile members 81 for pressing the tape 50 onto the substrate 60. This pad 82 is also made narrower than the tape 50 so as to prevent interference between the pad 82 and the edges of the tape 50.

When the apparatus 10 shown in FIGS. 3–5 is used for smoothing the substrate 60, the arm structures 80 are moved towards the substrate 60 and the rod 62 is retracted backward as shown in FIG. 5B such that the blocks 20 are pressed against the protruding members 72 by means of the mechanisms 73. The mobile members 81 are accordingly moved such that their pads 82 operate to press the tapes 50 against the substrate 60. Since the blocks 20 are subjected to the biasing forces of the springs 95, the forces with which the pads 82 press the tapes 50 against the substrate 60 depends on the biasing forces of the springs 95. Since the forces of the springs 95 on the blocks 20 can be detected by means of the pressure sensors 96, the forces with which the tapes 50 are pressed onto the substrate 60 can also be detected by the pressure sensors 96. The user can thus turn the knobs 91 of the block-moving mechanisms 73 appropriately to the right or to the left on the basis of the detection signals received from the pressure sensors 96 so as to adjust the compressive forces of the tapes 50 on the substrate 60 by way of the pads 82 on the arm structures 80.

When the substrate 60 is not being processed, the rod 62 is inserted between the protrusions 20*a* as shown in FIG. 5A so as to force them back into their holes 74 such that the blocks 20 move away from each other and the mobile members 81 retreat to their retracted positions. This releases the pads 82 from pressing the tapes 50 onto the substrate 60 and the pads 82 are separated from the tapes 50. Thus, also with the apparatus shown in FIG. 3, the pads contact the tapes when the apparatus is operated for smoothing the substrate 60 but they are separated and do not interfere with each other when the apparatus is not being operated. Thus, the tapes can be run without generating any debris particles.

What is claimed is:

1. An apparatus for smoothing a surface of a rotatably supported substrate, said apparatus comprising:

a base plate having a surface;

a first block having an extending arm structure, said first block being attached to said base plate so as to be movable along said surface of said base plate;

a first roller defining an axial direction and being attached to a tip portion of said arm structure in a direction perpendicular to said surface of said base plate;

a first mobile member attached to said arm structure so as to be movable in a direction perpendicular to said axial direction;

a first tape-running means attached to said base plate for feeding and taking up a polishing tape through said first roller so as to advance said tape around said first mobile member; and a first moving means attached to said arm structure of said first block for moving said first mobile member;

wherein said first mobile member has a first pad which presses said polishing tape from backside; and wherein said first mobile member moves by means of said first moving means to a retracted position where said first pad does not contact said polishing tape when said polishing tape is being run by means of said first tape-running means and to a compressing position where said first pad pushes said polishing tape when said substrate is being smoothed by said polishing tape.

2. The apparatus of claim 1 further comprising:

a second block having an extending arm structure, said second block being attached to said base plate so as to be movable along said surface of said base plate opposite said first second block;

a second roller attached to a tip portion of said arm structure of said second block in a direction perpendicular to said surface of said base plate;

a second mobile member attached to said arm structure of said second block so as to be movable in a direction perpendicular to the axial direction of said second roller;

a second tape-running means attached to said base plate for feeding and taking up another polishing tape through said second roller so as to advance said another tape around said second mobile member; and a second moving means attached to said arm structure of said second block for moving said second mobile member;

wherein said second mobile member has a second pad which presses said another polishing tape from backside; and wherein said second mobile member moves by means of said second moving means to a retracted position where said second does not contact said another polishing tape when said another polishing tape is being run by means of said second tape-running means and to a compressing position where said second pad pushes said another polishing tape when the other surface of said substrate is being smoothed by said another polishing tape.

3. The apparatus of claim 1 wherein said first pad is narrower than said polishing tape.

4. The apparatus of claim 2 wherein said first pad is narrower than said polishing tape and said second pad is narrower than said another tape.

5. An apparatus for smoothing a surface of a rotatably supported substrate, said apparatus comprising:

a base plate having a surface and an extending first arm structure;

a first roller defining an axial direction and being attached to a tip portion of said first arm structure in a direction perpendicular to said surface of said base plate;

a first block having a first mobile member extending along said first arm structure, said first block being attached to said base plate so as to be movable along said surface of said base plate;

a first tape-running means attached to said base plate for feeding and taking up a polishing tape through said first roller so as to advance said tape around said first mobile member; and a first moving means attached to said base plate for moving said first mobile member;

wherein said first mobile member has a first pad which presses said polishing tape from backside; and wherein said first mobile member moves by means of said first moving means to a retracted position where said first pad does not contact said polishing tape when said polishing tape is being run by means of said first tape-running means and to a compressing position where said first pad pushes said polishing tape when said substrate is being smoothed by said polishing tape.

6. The apparatus of claim 5 further comprising:

a second arm structure extending from said base plate parallel to said first extending arm structure such that said substrate can be disposed between said first and second arm structures;

a second roller attached to a tip portion of said second arm structure in a direction perpendicular to said surface of said base plate;

a second block having a second mobile member extending along said second arm structure, said second block being attached to said base plate so as to be movable opposite said first block;

a second tape-running means attached to said base plate for feeding and taking up another polishing tape through said second roller so as to advance said another tape around said second mobile member; and a second moving means attached to said base plate for moving said second mobile member;

wherein said second mobile member has a second pad which presses said another polishing tape from backside; and wherein said second mobile member moves by means of said second moving means to a retracted position where said second does not contact said another polishing tape when said another polishing tape is being run by means of said second tape-running means and to a compressing position where said second pad pushes said another polishing tape when the other surface of said substrate is being smoothed by said another polishing tape.

7. The apparatus of claim 5 wherein said first pad is narrower than said polishing tape.

8. The apparatus of claim 6 wherein said first pad is narrower than said polishing tape and said second pad is narrower than said another tape.

9. A method of smoothing a surface of a substrate by using an apparatus selected from the group consisting of the apparatus of claim 1 and the apparatus of claim 5, said method comprising the steps of:

moving said first mobile member to a retracted position where said first pad does not contact said polishing tape when said polishing tape is fed and taken up; and moving said first mobile member to a compressing position where said first pad pushes said polishing tape to said surface of said substrate.

10. The method of claim 9 wherein said first pad is narrower than said polishing tape.

11. A method of smoothing a surface of a substrate by using an apparatus selected from the group consisting of the apparatus of claim 2 and the apparatus of claim 6, said method comprising the steps of:

moving said first mobile member and said second mobile members each to a retracted position such that said first pad does not contact said polishing tape and said second pad does not contact said another polishing tape when said polishing tape and said another polishing tape are fed and taken up; and moving said first mobile member and said second mobile member each to a compressing position such that said first pad pushes said polishing tape to said surface of said substrate and said second pad pushes said another polishing tape to the opposite surface of said substrate.

12. The method of claim 11 wherein said first pad is narrower than said polishing tape and said second pad is narrower than said another tape.

* * * * *